US010901343B2

(12) United States Patent
Imamiya et al.

(10) Patent No.: US 10,901,343 B2
(45) Date of Patent: Jan. 26, 2021

(54) DEVELOPING DEVICE WITH REMOVABLE SEAL CLOSING PORT AND IMAGE FORMING APPARATUS HAVING THE SAME

(71) Applicant: TOSHIBA TEC KABUSHIKI KAISHA, Tokyo (JP)

(72) Inventors: Koji Imamiya, Kawasaki Kanagawa (JP); Masayuki Kasukawa, Misato Saitama (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/750,997

(22) Filed: Jan. 23, 2020

(65) Prior Publication Data

US 2020/0292965 A1 Sep. 17, 2020

(30) Foreign Application Priority Data

Mar. 15, 2019 (JP) ..... 2019-048816

(51) Int. Cl.
*G03G 15/08* (2006.01)

(52) U.S. Cl.
CPC ..... *G03G 15/0891* (2013.01); *G03G 15/0808* (2013.01); *G03G 2215/0687* (2013.01)

(58) Field of Classification Search
CPC ..... G03G 15/0822; G03G 15/0881; G03G 15/0887; G03G 15/0891; G03G 15/0893
USPC ..... 399/103, 106, 254–257
See application file for complete search history.

(56) References Cited

U.S. PATENT DOCUMENTS

| | | | | |
|---|---|---|---|---|
| 8,855,525 | B2 * | 10/2014 | Muto et al. | G03G 15/0822 399/103 |
| 9,804,527 | B2 * | 10/2017 | Nose et al. | G03G 15/0893 |
| 9,983,511 | B2 | 5/2018 | Sakamaki | |
| 10,423,095 | B2 * | 9/2019 | Takahashi et al. | G03G 15/0881 |
| 2013/0216257 | A1 | 8/2013 | Fujimura et al. | |
| 2015/0248078 | A1 | 9/2015 | Mugita et al. | |

OTHER PUBLICATIONS

U.S. Appl. No. 16/257,086, filed Jan. 25, 2019 (First Inventor: Koji Imamiya).
Extended European Search Report dated Aug. 5, 2020, mailed in corresponding European Patent Application No. 20159031.2, 9 pages.

* cited by examiner

*Primary Examiner* — William J Royer
(74) *Attorney, Agent, or Firm* — Kim & Stewart LLP

(57) ABSTRACT

A developing device includes first and second chambers, a developing roller, first and second mixers, and one or more removable seals. The developing roller is in the first chamber. The first mixer is in the first chamber and configured convey developer in a first direction along a rotational axis of the developing roller. The second chamber is connected to the first chamber via a first port and a second port that are spaced apart from each other in the first direction. The second mixer is in the second chamber and configured to convey developer in a second direction opposite to the first direction. The one or more removable seals cover the first and second ports. A developer is contained in one of the first or second chambers. A developer discharge port is provided on the other one of the first or second chambers.

20 Claims, 8 Drawing Sheets

DEVELOPING DEVICE WITH REMOVABLE SEAL CLOSING PORT AND IMAGE FORMING APPARATUS HAVING THE SAME

CROSS-REFERENCE TO RELATED APPLICATION

This application is based upon and claims the benefit of priority from Japanese Patent Application No. 2019-048816, filed on Mar. 15, 2019, the entire contents of which are incorporated herein by reference.

FIELD

Embodiments described herein relate generally to a developing device, an image forming unit, and an image forming apparatus.

BACKGROUND

An image forming apparatus includes a developing unit that supplies a developer to an image carrier on which an electrostatic latent image has been formed to develop the latent image. The developer comprises toner particles and a carrier which is providing within the developing unit in advance. As the toner in the developing unit is consumed, the toner must be replenished from a developer cartridge or the like. The carrier may also deteriorate when used for a long time. A recent developer cartridge type includes a small amount of carrier together with the toner. When the toner is replenished from such a developer cartridge, a small amount of carrier is also replenished in (added to) the developing unit at the same time. Recent developing units have included or provided a discharge unit for discharging surplus carrier. When new carrier is added, the developing unit discharges the now surplus, older carrier via the discharge unit.

At the start of use of an image forming apparatus, the developer may be unevenly disposed on one side in the developing unit. At this initial time, there is a possibility that developer including the new carrier will be discharged from the discharge unit even though it has just been added to the developing unit of the image forming apparatus. For that reason, a developing unit capable of preventing the unintended discharge of the newly added developer would be desirable.

DETAILED DESCRIPTION

One or more example embodiments of the present disclosure provide a developing device, an image forming unit, and an image forming apparatus that can prevent unintended discharge of a developer.

In general, according to an embodiment, a developing device includes first and second chambers, a developing roller, first and second mixers, and one or more removable seals. The developing roller is in the first chamber, a part of the developing roller is exposed to an outside of the first chamber. The first mixer is in the first chamber and configured to convey developer in a first direction along a rotational axis of the developing roller. The second chamber is connected to the first chamber via a first port and a second port that are spaced apart from each other in the first direction. The second mixer is in the second chamber and configured to convey developer in a second direction opposite to the first direction. The one or more removable seals cover the first port and the second port. A developer is contained in one of the first and second chambers. A developer discharge port is on the other one of the first and second chambers.

Hereinafter, a developing device, an image forming unit, and an image forming apparatus according to example embodiments will be described with reference to the drawings.

Figure 1:
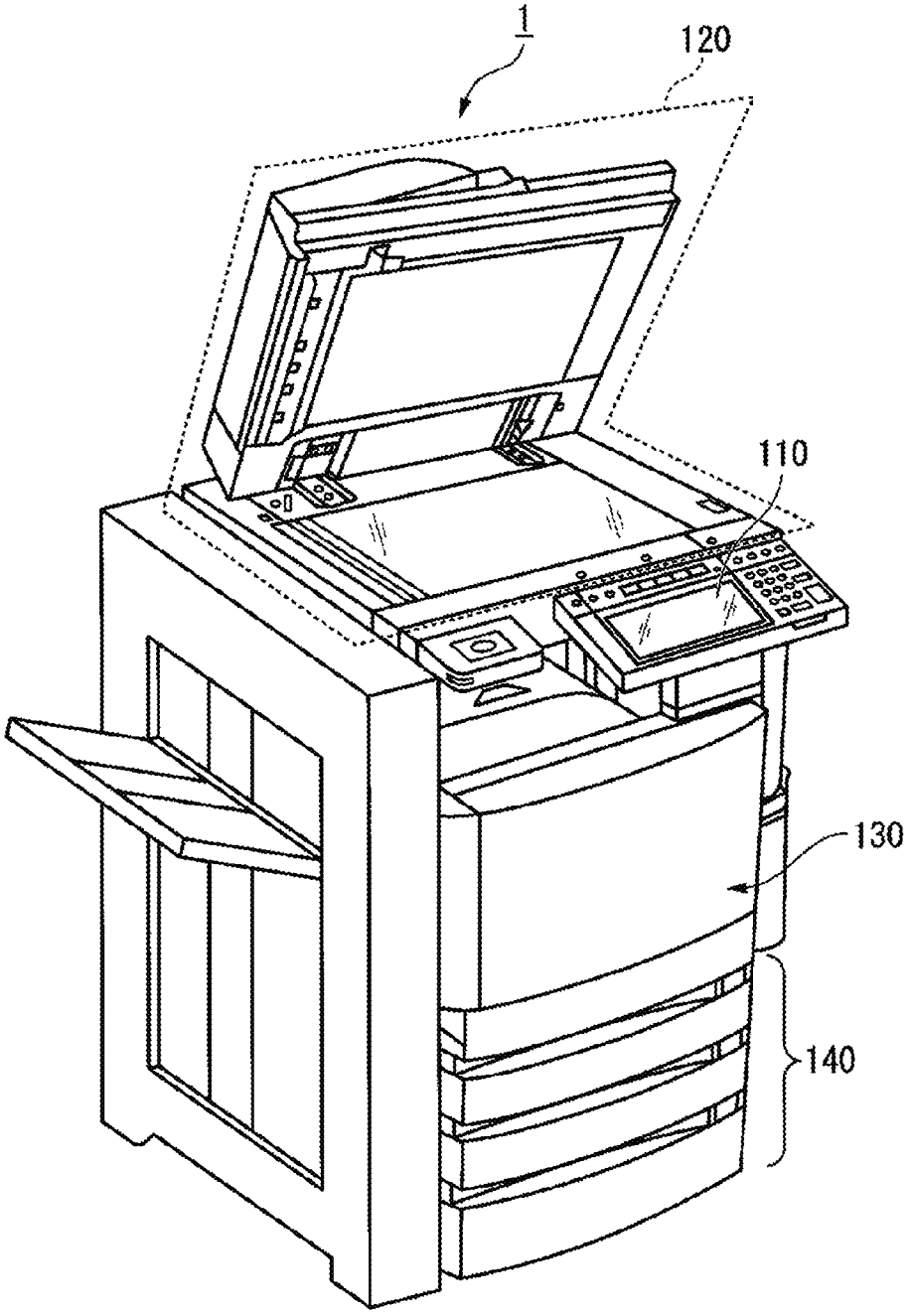
FIG. 1 illustrates an external view of an example of an image forming apparatus according to an embodiment.

FIG. 1 illustrates an external view of an example of an image forming apparatus 1 according to the embodiment. For example, the image forming apparatus 1 is a multifunction peripheral (MFP). The image forming apparatus 1 can read an image printed or otherwise formed on a recording medium such as a sheet of paper and generates digital data (referred to as an image file) corresponding to the image on the recording medium (referred to as a sheet). The image forming apparatus 1 forms an image on a sheet with toner based on the digital data.

The image forming apparatus 1 includes a display unit 110, an image reading unit 120, an image forming section 130, and a sheet tray 140.

The display unit 110 operates as an output interface and displays messages and information to a user as characters and images. The display unit 110 also operates as an input interface and receives instructions from a user via the input interface. For example, the display unit 110 is a touch panel type liquid crystal display.

For example, the image reading unit 120 is a color scanner. Color scanners include a contact image sensor (CIS), charge coupled devices (CCD), and the like. The image reading unit 120 reads an image from a sheet using a sensor, and generates digital data (e.g., an image file) by the reading.

The image forming section 130 forms an image on a sheet using toner. The image forming section 130 uses the image data read by the image reading unit 120 or other image data received from an external device and forms an image according to the image data on the sheet. For example, an image formed on a sheet is an output image and may be referred to in some contexts as a hard copy, a printout, or the like.

The sheet tray 140 supplies sheets used by the image forming section 130.

Figure 2:
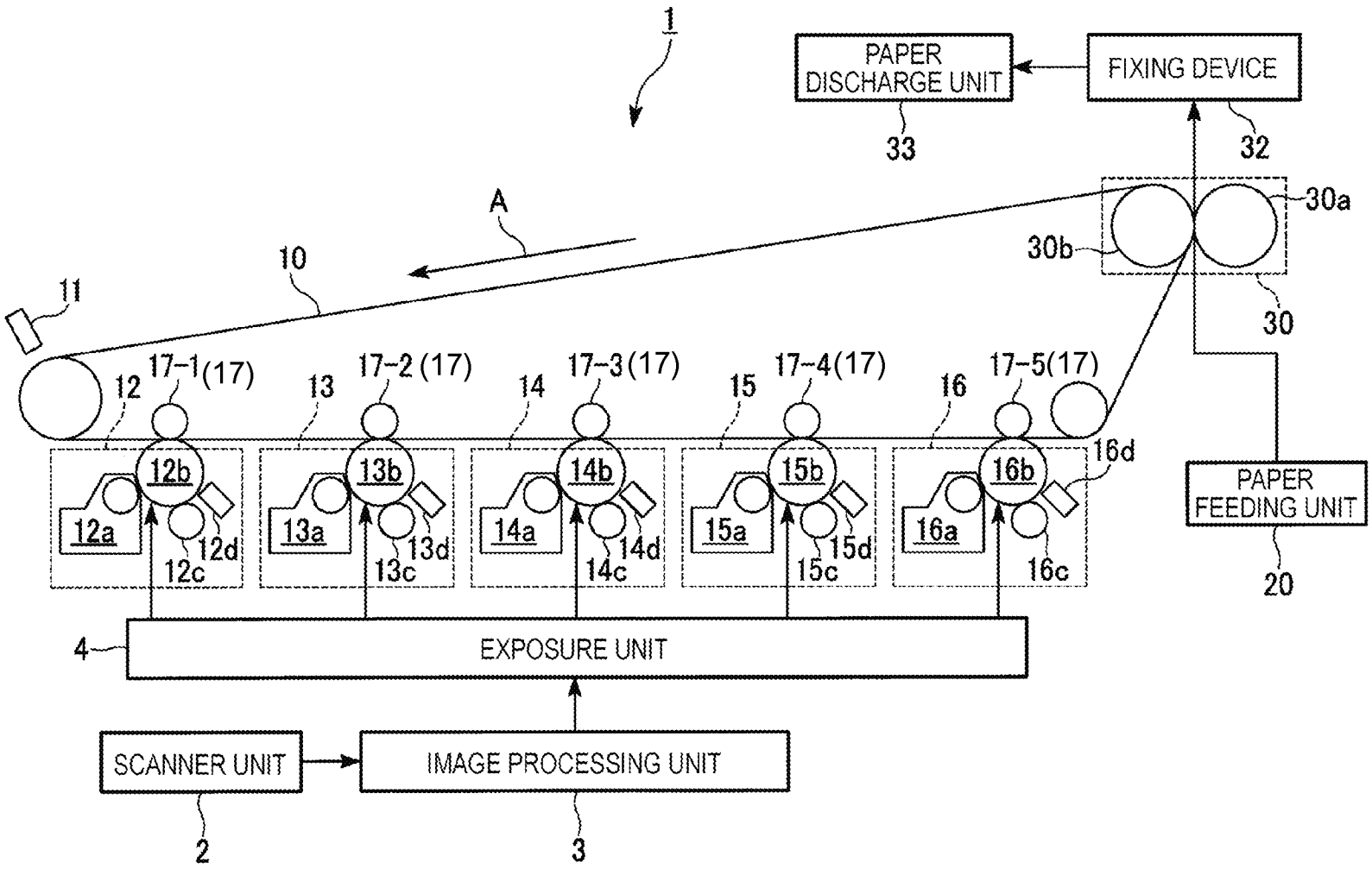
FIG. 2 is a diagram illustrating an example of a schematic configuration of the image forming apparatus.

FIG. 2 is a diagram illustrating an example of a schematic configuration of the image forming apparatus 1 according to the embodiment. The image forming apparatus 1 is an electrophotographic image forming apparatus. The image forming apparatus 1 in this example is a five-tandem image forming apparatus in reference to the arrangement of image forming units.

The image forming apparatus 1 includes a scanner unit 2, an image processing unit 3, an exposure unit 4, an intermediate transfer body 10, a cleaning blade 11, image forming units 12, 13, 14, 15, and 16, primary transfer rollers 17-1, 17-2, 17-3, 17-4, and 17-5, a paper feeding unit 20, a secondary transfer unit 30, a fixing device 32, a paper discharge unit 33, and a control unit (not separately illustrated). Hereinafter, when the primary transfer rollers are not required to be distinguished in the description, each primary transfer roller can be more simply referred to as a primary transfer roller 17.

In the following description, since the sheet is generally conveyed from the paper feeding unit 20 to the paper discharging unit 33, the paper feeding unit 20 side is referred to as the upstream side along the sheet conveying direction, and the paper discharging unit 33 side is referred to as the downstream side along the sheet conveying direction. A direction orthogonal to the sheet conveying direction is referred to as a sheet width direction.

Transfer in the image forming apparatus 1 includes a first transfer process and a second transfer process. In the first transfer process (a primary transfer), the primary transfer roller 17 transfers a toner image formed on the photosensitive drum of an image forming unit (each of image forming units 12 to 16, as necessary) to the intermediate transfer body 10. In the second transfer process (a secondary transfer), the secondary transfer unit 30 transfers the toner images on the intermediate transfer body 10 to the sheet.

The scanner unit 2 reads an image formed on a sheet. For example, the scanner unit 2 reads an image from a sheet and generates image data of three colors red (R), green (G), and blue (B). The scanner unit 2 outputs this generated image data to the image processing unit 3.

The image processing unit 3 converts the image data into color signals. For example, the image processing unit 3 converts the (RGB) image data into four-color image data with color signals for yellow (Y), magenta (M), cyan (C), and black (K). The image processing unit 3 controls the exposure unit 4 based on the color signal of each color (CYMK).

The exposure unit 4 irradiates the photosensitive drum of the image forming unit according to a corresponding color signal. The exposure unit 4 includes an exposure light source such as a laser, an LED or the like.

The intermediate transfer body 10 is a belt or the like. The intermediate transfer body 10 rotates in the direction indicated by arrow A in FIG. 2. A toner image is formed on the surface of the intermediate transfer body 10.

The cleaning blade 11 removes toner still adhering to the intermediate transfer body 10 after passing through the fixing device 32.

The image forming units 12 to 16 form images using toners of the five respective colors (5 colors in the example illustrated in FIG. 2). The image forming units 12 to 16 are installed in sequence along the intermediate transfer body 10.

The primary transfer rollers 17 (17-1 to 17-5) are used when transferring the toner images formed by the image forming units 12 to 16 to the intermediate transfer body 10.

The paper feeding unit 20 feeds each sheet.

The secondary transfer unit 30 includes a secondary transfer roller 30*a* and a secondary transfer counter roller 30*b*. The secondary transfer unit 30 transfers the toner image formed on the intermediate transfer body 10 to a sheet.

In the secondary transfer unit 30, the intermediate transfer body 10 and the secondary transfer roller 30*a* are in contact with each other. For the purpose of alleviating paper jams, the intermediate transfer body 10 and the secondary transfer roller 30*a* may be configured to be separated from each other.

The fixing device 32 heats and presses the toner image transferred to the sheet to fix the toner image to the sheet. The sheet on which the image is formed by the fixing device 32 is discharged from the paper discharge unit 33 to outside the apparatus.

Next, the image forming units 12 to 16 will be described.

The image forming units 12 to 15 form toner images with toners of colors corresponding to the four colors used for color printing. The four colors for color printing are yellow (Y), magenta (M), cyan (C), and black (K) colors. In this example, the four color toners for color printing are non-decolorable toners. The image forming unit 16 forms a toner image with a decolorable toner. The image forming units 12 to 15 and the image forming unit 16 have the same configuration, although the toners for forming the toner images are different. In some examples, the image forming apparatus 1 may omit the image forming unit 16 that creates a decolorable toner image.

The image forming unit 12 will be described as a representative of each of image forming units 12 to 16, and since the other image forming units 13 to 16 have the same configuration, the specific description thereof will not be repeated.

The image forming unit 12 includes a developing device 12*a*, a photosensitive drum 12*b*, a charger 12*c*, and a cleaning blade 12*d* (also referred to as a cleaning member or cleaning unit). The image forming unit 12 may include a static eliminator. The image forming unit 12 is attachable to and detachable from the image forming apparatus 1. When various components of the image forming unit deteriorate, the old image forming unit can be replaced with a new image forming unit. Among the components of the image forming unit 12, the developing device 12*a* can be separately attached to and detached from the image forming unit 12 and the image forming apparatus 1.

In FIG. 2, each image forming unit 13 to 16 is similarly depicted with components corresponding to those described for image forming unit 12. That is, each image forming unit 13 to 16 similarly, respectively, includes a developing device 13*a*, 14*a*, 15*a*, 16*a*; a photosensitive drum 13*b*, 14*b*, 15*b*, 16*b*; a charger 13*c*, 14*c*, 15*c*, 16*c*; and a cleaning blade 13*d*, 14*d*, 15*d*, 16*d*.

The developing device 12*a* contains a developer (recording agent). The developer includes toner therein. The developing device 12*a* adheres toner to the photosensitive drum 12*b*. For example, the toner is used as part of a two-component developer combined with a carrier. For example, iron powder or ferrite particles having a particle size of several tens of microns (μm) are used as the carrier. In this example embodiment, a two-component developer containing nonmagnetic toner is used.

The photosensitive drum 12*b* is one possible example of an image carrier. The photosensitive drum 12*b* includes a photoconductor on the outer peripheral surface. The photoconductor forms a photosensitive or photoresponsive region. For example, the photoconductor is an organic photoconductor (OPC). The charger 12*c* uniformly charges the surface of the photosensitive drum 12*b*. The cleaning blade 12*d* removes the toner adhering to the photosensitive drum 12*b*. The toner removed by the cleaning blade 12*d* is collected in a waste toner box (not separately illustrated).

Next, an outline of the operation of the image forming unit 12 will be described. The photosensitive drum 12*b* is charged to a predetermined potential by the charger 12*c*. Next, light is emitted from the exposure unit 4 on to the photosensitive drum 12*b*. As a result, the potential of the region on the photosensitive drum 12*b* irradiated with light changes. By this change, an electrostatic latent image is formed on the surface of the photosensitive drum 12*b*. The electrostatic latent image on the surface of the photosensitive drum 12*b* is then developed with the toner from the developing device 12*a*. An image (a toner image) developed with the toner is thus formed on the surface of the photosensitive drum 12*b*.

The toner image formed on the surface of the photosensitive drum 12*b* is then transferred to the intermediate transfer body 10 by the primary transfer roller 17-1 facing the photosensitive drum 12*b*. The toner image formed on the intermediate transfer body 10 is later transferred to a sheet by the secondary transfer unit 30.

Figure 3:
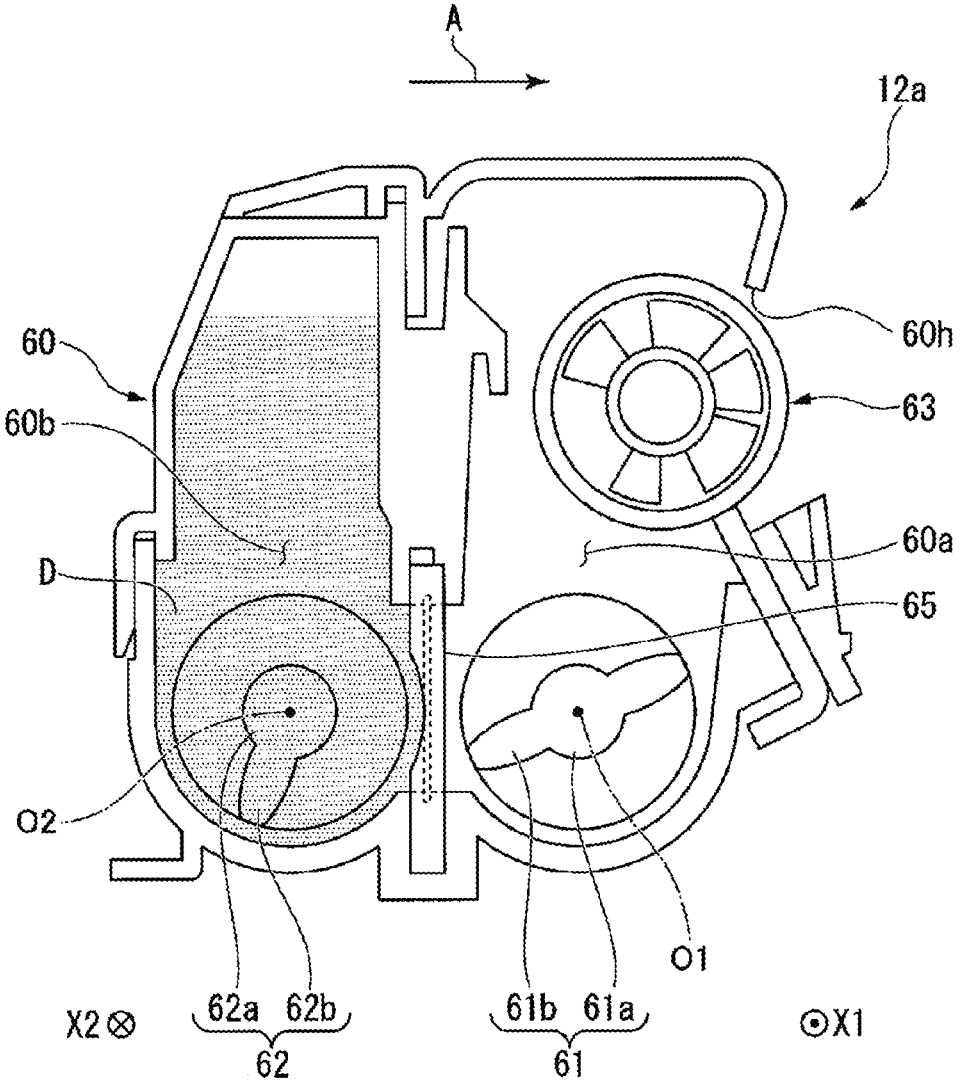
FIG. 3 illustrates a front cross-sectional view of a developing device.
Figure 4:
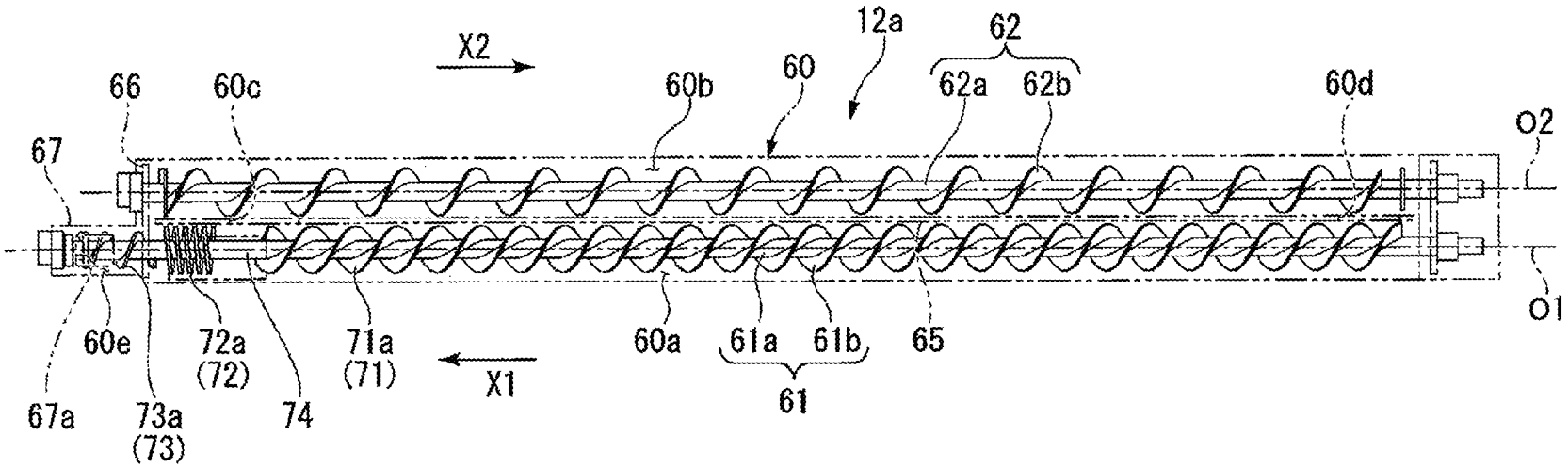
FIG. 4 illustrates a plan view of an inside of the developing device.

Next, the developing device 12*a* will be described. FIG. 3 illustrates a front cross-sectional view of the developing device 12*a* according to the embodiment. FIG. 4 illustrates a plan view of the inside of the developing device 12*a* according to the embodiment. FIG. 3 illustrates a cross section of the developing device 12*a* viewed from the sheet width direction. The left to right direction in FIG. 3 corresponds a direction of travel for the intermediate transfer body 10 along the rotation direction (arrow A). Hereinafter, the left side of FIG. 3 is referred to as the upstream side in the transfer body rotation direction, and the right side of FIG. 3 is referred to as the downstream side in the transfer body rotation direction. In FIG. 3, hatching of the cross section is omitted.

As illustrated in FIGS. 3 and 4, the developing device 12*a* includes a developing container 60, a developing roller 63, a first mixer 61, and a second mixer 62. The left to right direction in FIG. 4 is the sheet width direction. In FIG. 4, the illustration of the developing roller 63 is omitted. Hereinafter, the rotation axis direction of the developing roller 63 is simply referred to as a rotation axis direction or an axial direction. A direction (the left direction in FIG. 4) from a first conveying unit 71 of the first mixer 61 toward a third conveying unit 73 along the rotation axis direction is the X1 direction. The direction opposite to the X1 direction (the right direction in FIG. 4) is the X2 direction. The line O1 in the drawing indicates the rotational center line (axis) of the first mixer 61, and the line O2 indicates the rotational center line (axis) of the second mixer 62.

As illustrated in FIG. 3, the developing container 60 can contain a developer. The developer includes a carrier that is a magnetic material and a toner that is a colorant. The developing container 60 contains an initial developer D. In the present specification, "initial developer" means a developer that was provided in advance (e.g., at initial assembly of the image forming apparatus 1 or otherwise previously provided within the image forming apparatus 1) within the developing device 12*a* before the present use of the image forming apparatus 1 started. Hereinafter, the initial developer D may be simply referred to as the developer D.

The developing container 60 extends linearly in a longitudinal direction. For the developing container 60, the sheet width direction is considered the longitudinal direction. The developing container 60 has a substantially rectangular cross-sectional shape. The developing container 60 is disposed adjacent to the photosensitive drum 12*b* (see FIG. 2). An axial direction of the photosensitive drum 12*b* is also disposed along the sheet width direction. The longitudinal direction of the developing container 60 is thus disposed parallel to the axial direction of the photosensitive drum 12*b*.

The developing container 60 includes an opening 60*h* on the side facing the photosensitive drum 12*b*. The opening 60*h* faces the photosensitive drum 12*b* in the radial direction of the photosensitive drum 12*b*. A developing roller 63 is disposed at a position facing the opening 60*h* inside the developing container 60. The developing roller 63 is disposed such that the axial direction is along the sheet width direction.

The developing roller 63 is disposed in parallel with the photosensitive drum 12*b*. The developing roller 63 faces the photosensitive drum 12*b* in the radial direction through the opening 60*h*. The developing roller 63 is rotatably supported by the developing container 60 at both end portions in the axial direction. The developing roller 63 carries the developer on the outer peripheral surface. The developing roller 63 causes the developer to adhere to the outer peripheral surface by the magnetic force of the magnetic material disposed inside.

Inside the developing container 60, the shaft-shaped first mixer 61 and second mixer 62 are disposed. The first mixer 61 and the second mixer 62 are disposed such that the axial direction thereof is along the sheet width direction. The first mixer 61 and the second mixer 62 are disposed in parallel to each other. The first mixer 61 is disposed on the downstream side (relative to the transfer body rotation direction). The second mixer 62 is disposed on the upstream side in the transfer body rotation direction.

A first conveyance chamber 60*a* that accommodates the first mixer 61 is formed on the downstream side (in the transfer body rotation direction) of the developing container 60. A second conveyance chamber 60*b* that accommodates the second mixer 62 is formed on the upstream side (relative to the transfer body rotation direction) of the developing container 60. The first conveyance chamber 60*a* and the second conveyance chamber 60*b* are formed so that the width in the vertical direction is larger than the width in the rotation direction of the transfer body in the cross-sectional view of FIG. 3.

The first mixer 61 is accommodated in the lower portion of the first conveyance chamber 60*a*. The second mixer 62 is accommodated in the lower portion of the second conveyance chamber 60*b*. The developing roller 63 is accommodated in the upper portion of the first conveyance chamber 60*a*. A part of the outer peripheral surface of the developing roller 63 is exposed inside the first conveyance chamber 60*a*. The developing roller 63, the first mixer 61, and the second mixer 62 are rotationally driven in cooperation with a driving source.

Inside the developing container 60, a partition wall 65 that partitions the first conveyance chamber 60*a* and the second conveyance chamber 60*b* is provided. The first conveyance chamber 60*a* and the second conveyance chamber 60*b* are adjacent to each other with the partition wall 65 interposed therebetween. The partition wall 65 is provided extending along the vertical direction.

As illustrated in FIG. 4, a pair of communication ports 60*c* and 60*d* that connect the first conveyance chamber 60*a* and the second conveyance chamber 60*b* to permit communication therebetween are formed on both sides of the partition wall 65 in the sheet width direction (rotation axis direction). The pair of communication ports 60*c* and 60*d* are disposed apart from each other in the rotation axis direction. The pair of communication ports 60*c* and 60*d* enables the developer to circulate (move) between the first conveyance chamber 60*a* and the second conveyance chamber 60*b*. The communication ports 60*c* and 60*d* are formed in a rectangular shape, for example. Hereinafter, the communication port 60*c* in the X1 direction is referred to as a first communication port 60*c*, and the communication port 60*d* in the X2 direction is referred to as a second communication port 60*d*.

Figure 5:
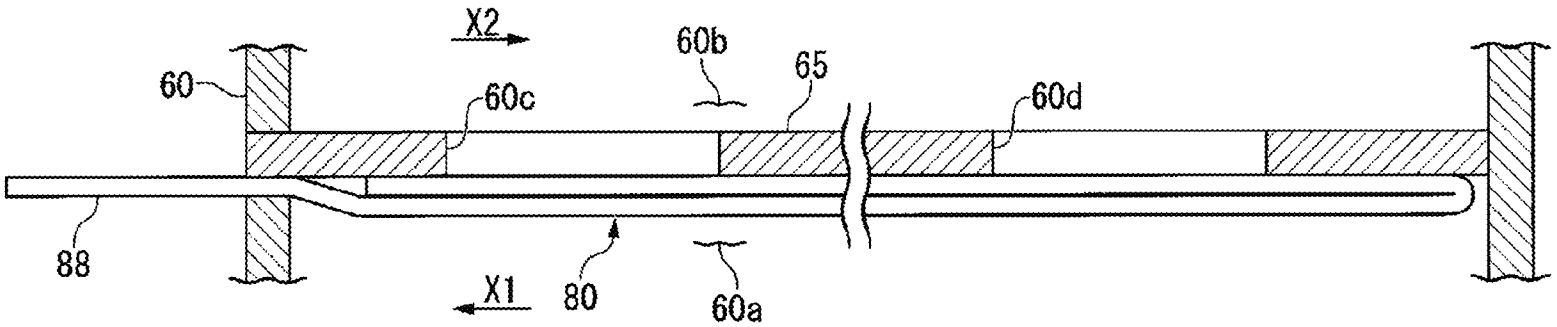
FIG. 5 illustrates a cross-sectional plan view of the periphery of a partition wall of the developing device.

FIG. 5 illustrates a cross-sectional plan view of the periphery of the partition wall 65 of the developing device 12*a* according to the embodiment. A closing member 80, which may be also referred to as a removal seal or a seal member, closes (covers) the pair of communication ports 60*c* and 60*d* but is also openable/removable. The closing member 80 is formed in a band shape and has an adhesive surface on one side. The closing member 80 is disposed along the partition wall 65 extending in the rotation axis direction. The adhesive surface of the closing member 80 is attached to the surface of the partition wall 65 on the first conveyance chamber 60*a* side. The closing member 80 closes the pair of communication ports 60*c* and 60*d*. In an embodiment, the closing member 80 may consist of multiple portions that respectively close the communication ports 60*c* and 60*d*. At the end portion of the partition wall 65 in the X2 direction, the closing member 80 is folded back upon itself in the X1 direction. An end portion 88 in the X1 direction of the closing member 80 extends beyond the outermost end of developing container 60.

At the start of use of the image forming apparatus 1, the operator pulls the end portion 88 of the closing member 80 in the X1 direction. The closing member 80 peels away from the surface of the partition wall 65 from the X2 direction end toward the X1 direction end. When the entire closing member 80 has been peeled off from the partition wall 65, the closing member 80 is pulled out of the developing container 60. Thereby, the pair of communication ports 60*c* and 60*d* are opened. That is, the closing member 80 initially closes the pair of communication ports 60*c* and 60*d* but permits opening of the pair of communication ports 60*c* and 60*d* upon initial use.

As illustrated in FIG. 4, the first mixer 61 includes a shaft portion 61*a* along the rotation axis direction, and a spiral blade 61*b* (also referred to as an agitating blade) formed on the outer periphery of the shaft portion 61*a*. The spiral blade 61*b* is provided to cover the entire length of the first mixer 61 excluding a part of the first mixer 61 in the X1 direction. The end portion of the first mixer 61 in the X1 direction is provided to extend further in the X1 direction than the end portion of the second mixer 62 in the X1 direction.

The second mixer 62 includes a shaft portion 62*a* along the rotation axis direction, and a spiral blade (agitating blade) 62*b* formed on the outer periphery of the shaft portion 62*a*. The spiral blade 62*b* is provided to cover the entire length of the second mixer 62.

In the X1 direction of the developing container 60, an end wall portion 66 that closes the end portions of the first conveyance chamber 60*a* and the second conveyance chamber 60*b* in the X1 direction, and a cylindrical wall portion 67 that is provided to protrude from the end wall portion 66 in the X1 direction, are formed. The cylindrical wall portion 67 is disposed coaxially with the first mixer 61 in the X1 direction of the first mixer 61. The cylindrical wall portion 67 has a bottomed cylindrical shape that opens toward the end wall portion 66 side (X2 direction). The end wall portion 66 communicates the inside of the cylindrical wall portion 67 with the inside of the first conveyance chamber 60*a*. A discharge unit 60*e* for discharging the developer to the outside is provided in the cylindrical wall portion 67.

The first communication port 60*c* is formed between the end portion in the X1 direction of the spiral blade 61*b* of the first mixer 61 and the end portion in the X1 direction of the spiral blade 62*b* of the second mixer 62.

The second communication port 60*d* is formed between the end portion in the X2 direction of the spiral blade 61*b* of the first mixer 61 and the end portion in the X2 direction of the spiral blade 62*b* of the second mixer 62.

The first mixer 61 conveys the developer in the X1 direction. The second mixer 62 conveys the developer in the X2 direction opposite to the first mixer 61.

Above the developing device 12*a*, a developer replenishing device used to replenish the developing device 12*a* with a developer can be provided. The developer replenishing device can be a developer cartridge that is attachable to and detachable from the image forming apparatus 1. The developer replenishing device replenishes the toner in the developing device 12*a* after toner in the developing device 12*a* is consumed by use (printing).

A toner concentration in the developer stirred and conveyed in the developing device 12*a* can be detected by a toner concentration detector. For example, the toner concentration detector can be disposed on the bottom surface of the second conveyance chamber 60*b*. When the detected toner concentration becomes a specified value or less, the developer in the developing device 12*a* is replenished from the developer replenishing device. The added developer is mixed with the developer already in the developing device 12*a* to increase the toner concentration of the developer in the developing device 12*a*. Accordingly, the toner concentration of the developer in the developing device 12*a* can be kept near constant.

The carrier is also replenished simultaneously with the toner from the developer replenishing device. However, the added amount of carrier (replenishment amount) causes an excess amount of developer to be in the developing device 12*a* (since, generally, carrier is not substantially consumed in printing processes). The excess amount of developer must be discharged to the outside of the developing container 60 from a discharge port 67*a* of the discharge unit 60*e* provided in the X1 direction of the first conveyance chamber 60*a*. As a result, the amount of developer in the developing device 12*a* can be kept near constant, and the old and deteriorated carrier in the developing device 12*a* is gradually replaced with new carrier. The discharge port 67*a* is provided in the lower portion of the cylindrical wall portion 67. The developer discharged from the discharge port 67*a* is collected in a waste toner box or the like.

Figure 6:
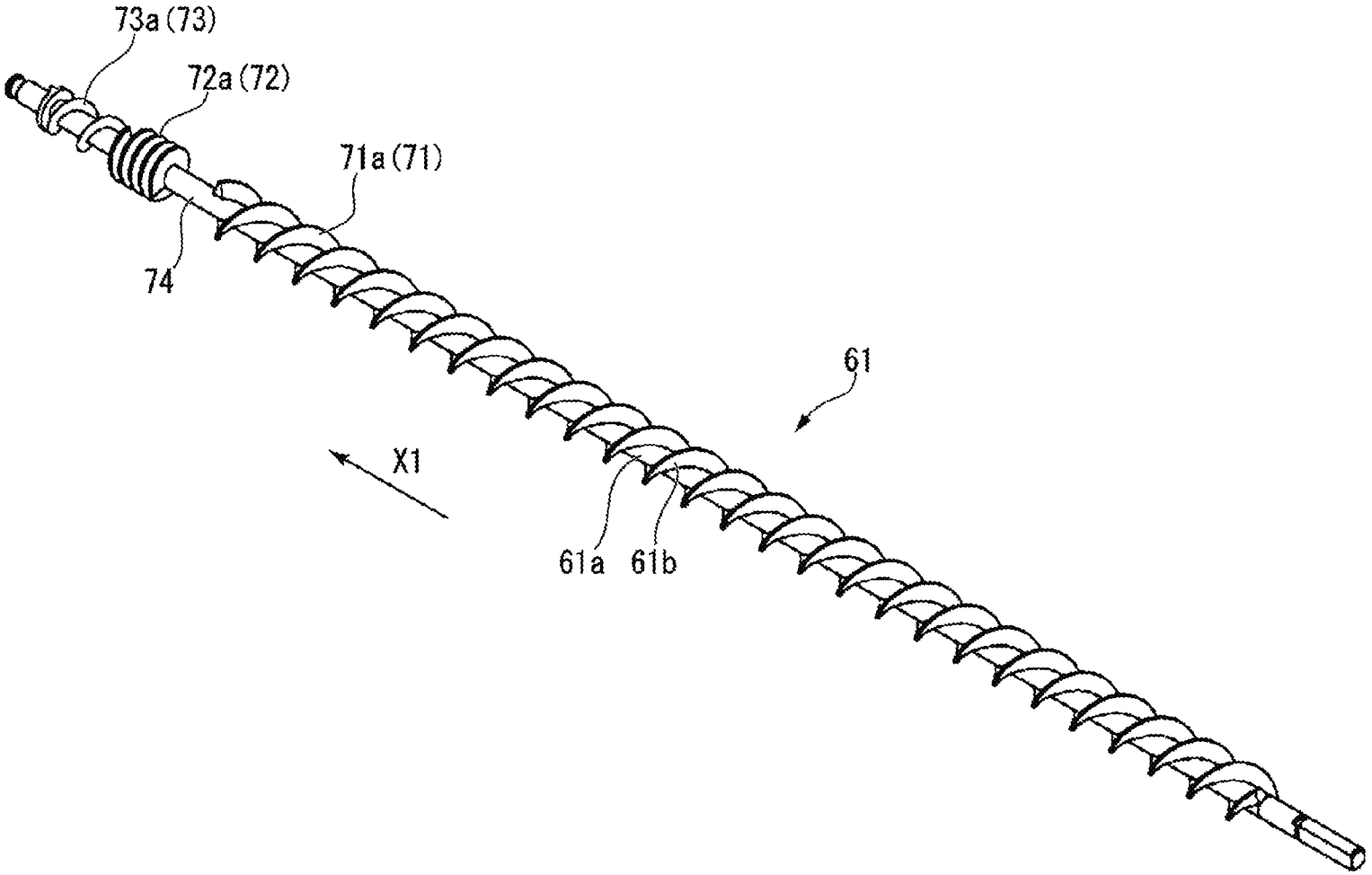
FIG. 6 illustrates a perspective view of a first mixer.
Figure 7:
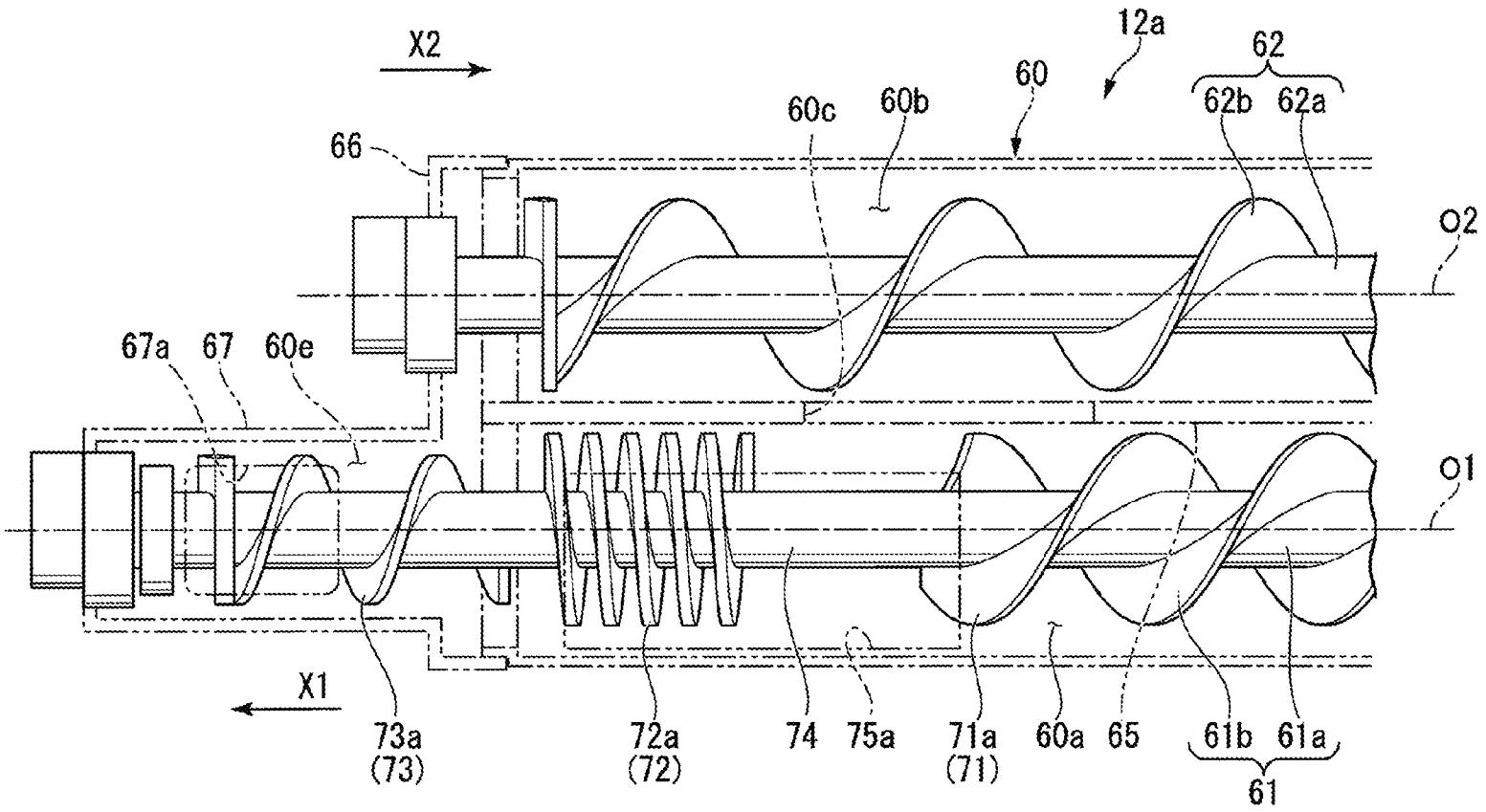
FIG. 7 illustrates a plan view of a periphery of a conveyance reduction unit.
Figure 8:
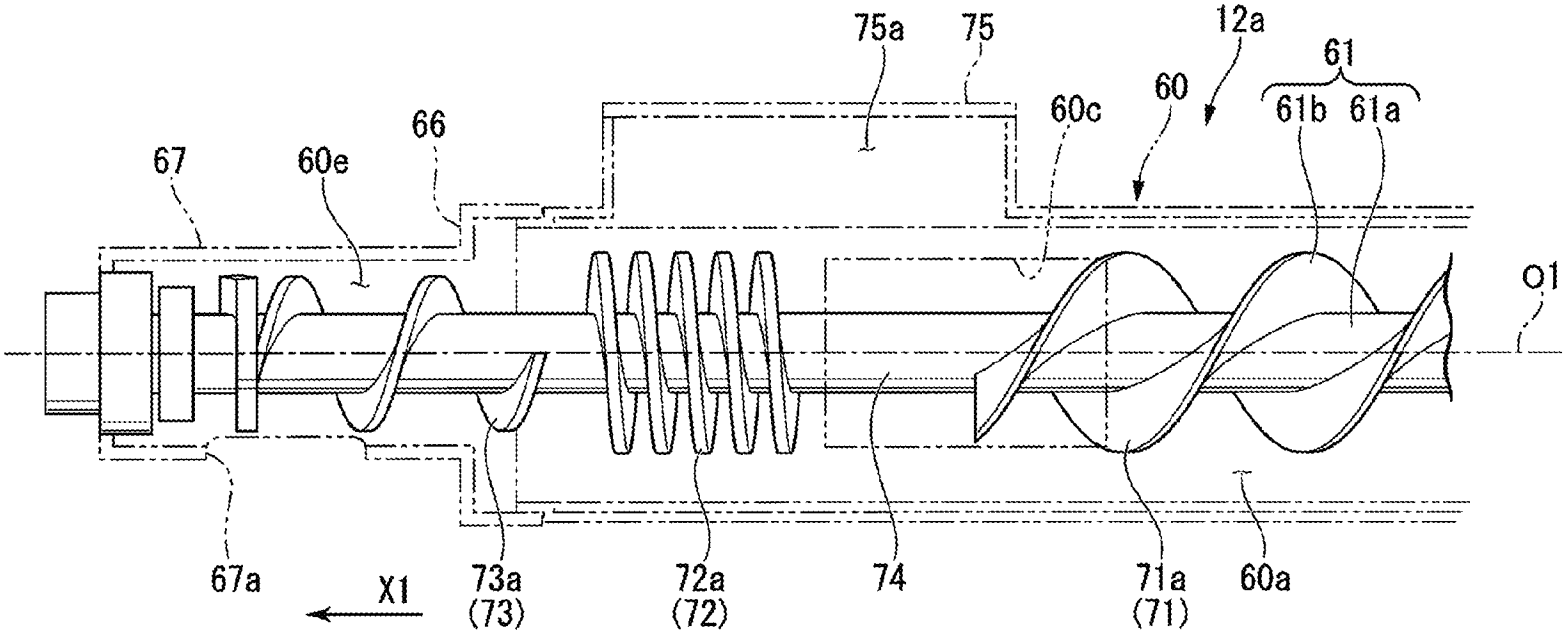
FIG. 8 illustrates a front view of a periphery of the conveyance reduction unit.

FIG. 6 illustrates a perspective view of the first mixer 61 of the developing device 12*a* according to the embodiment. FIG. 7 illustrates a plan view of the periphery of a conveyance reduction unit 74 of the embodiment. FIG. 8 illustrates a front view of the periphery of the conveyance reduction unit 74 of the embodiment.

As illustrated in FIGS. 6 to 8, the spiral blade 61*b* of the first mixer 61 is conceptually divided into a first conveying unit 71 portion, a second conveying unit 72 portion, and a third conveying unit 73 portion.

The first conveying unit 71 is provided in an area from the portion of the first mixer 61 that overlaps with the first communication port 60*c* in the rotation axis direction to the end portion of the first mixer 61 in the X2 direction. For example, the first conveying unit 71 is formed by winding two lines of spiral blades (a first blade portion 71*a*) with a pitch of 26 mm. In this example, the minimum interval at the first blade portion 71*a* of the first conveying unit 71 is 13 mm. This minimum interval 13 mm is the minimum pitch of the first conveying unit 71.

The second conveying unit 72 is provided in the X1 direction (the downstream side in the conveying direction of the first conveying unit 71) closer to the end portion of the first mixer 61 in the X1 direction than the first conveying unit 71. The second conveying unit 72 rotates with the first conveying unit 71. The second conveying unit 72, by its rotation, conveys (pushes back) developer in a direction opposite to the developer conveying direction of the first conveying unit 71 (the upstream side). For example, the second conveying unit 72 is formed by winding one line of a reverse spiral blade (a second blade portion 72*a*) with a pitch of 3 mm. For example, the standing height of the second blade portion 72*a* from the shaft portion 61*a* is the same as the standing height of the first blade portion 71*a* from the shaft portion 62*a*.

The third conveying unit 73, by its rotation, conveys the developer that has overcome the second conveying unit 72 to be past in the X1 direction (the downstream side in the conveying direction of the first conveying unit 71) the second conveying unit 72 toward the discharge port 67*a*. The third conveying unit 73 rotates together with the first conveying unit 71 and the second conveying unit 72, and conveys the developer in the same direction (the downstream side) as the first conveying unit 71. For example, the third conveying unit 73 is formed by winding one line of a spiral blade (a third blade portion 73*a*) with a pitch of 10 mm. For example, the standing height of the third blade portion 73*a* from the shaft portion 61*a* is less than the standing height of the first blade portion 71*a* from the shaft portion 61*a*. The third conveying unit 73 is disposed in the discharge unit 60*e* in the cylindrical wall portion 67 of the developing container 60.

Between the first conveying unit 71 and the second conveying unit 72, the conveyance reduction unit 74 is provided to reduce the amount of the conveyed between the first conveying unit 71 and the second conveying unit 72. For example, the conveyance reduction unit 74 is only the shaft portion 61*a* without the spiral blade 61*b* or any other blade portion. The conveyance reduction unit 74 is provided at a position which overlaps with the first communication port 60*c* in the rotation axis direction. The conveyance reduction unit 74 has a configuration in which generates a developer pool where the first communication port 60*c* and the first mixer 61 face each other.

The second conveying unit 72 is disposed further in the X1 direction than the first communication port 60*c* (that is, at a position which does not overlap with the first communication port 60*c*). With this arrangement, the developer more easily moves from the first conveyance chamber 60*a* to the second conveyance chamber 60*b* through the first communication port 60*c*.

The width of the conveyance reduction unit 74 along the rotation axis direction is set in this example between 1/2 and 3/2 of the minimum pitch of the first conveying unit 71. Preferably, the width of the conveyance reduction unit 74 in the rotation axis direction is set to be substantially the same as the minimum pitch of the first conveying unit 71. Here, "substantially the same" means, for example, the extent to which the width of the conveyance reduction unit 74 in the rotation axis direction varies in this context is about ±10% with respect to the minimum pitch (e.g., 13 mm) of the first conveying unit 71.

As illustrated in FIG. 8, the developing container 60 of the developing device 12*a* includes a space forming unit 75 above the conveyance reduction unit 74. The space forming unit 75 has a rectangular box shape and is open downward. The space forming unit 75 forms an open space 75*a* inside (see also FIG. 7). The space forming unit 75 provides the open space 75*a* facing the conveyance reduction unit 74 from above.

The space forming unit 75 straddles the conveyance reduction unit 74 and the second conveying unit 72 in the rotation axis direction. The space forming unit 75 faces the conveyance reduction unit 74 and the second conveying unit 72 from above. The space forming unit 75 straddles the entire width of the conveyance reduction unit 74 and at least half of the second conveying unit 72, in the rotation axis direction.

When the first mixer 61 rotates at a low speed, the developer easily gets past the second conveying unit 72, and an undesirably large amount of developer would be discharged from the discharge port 67*a*. However, when the first mixer 61 rotates at a high speed, it becomes more difficult for the developer to get past the second conveying unit 72, and the amount of developer circulating in the developing container 60 increases. The space forming unit 75 has a function of more accurately maintaining the developer amount in the developing container 60 at a specified (target) amount regardless of the rotation speed of the first mixer 61.

The operation of the developing device according to the embodiment will be described. As illustrated in FIG. 3, the initial developer D is contained only in the second conveyance chamber 60*b* of the developing device 12*a* before the start of use of the image forming apparatus 1. The discharge unit 60*e* is formed only in the first conveyance chamber 60*a*. At the start of use of the image forming apparatus 1, the operator pulls out the closing member 80 (illustrated in FIG. 5) in the X1 direction. Accordingly, the pair of communication ports 60*c* and 60*d* formed in the partition wall 65 are opened.

The operator starts the operations of the image forming apparatus 1. The second mixer 62 rotates and conveys the developer D contained in the second conveyance chamber 60*b* in the X2 direction. The developer D moves to the first conveyance chamber 60*a* through the second communication port 60*d* at the end portion in the X2 direction. The start of the operations of the image forming apparatus 1 also causes the first mixer 61 to rotate. The first conveying unit 71 conveys the developer D in the first conveyance chamber 60*a* in the X1 direction. A part of the outer periphery of the developing roller 63 is exposed inside the first conveyance chamber 60*a*. A part of the developer D moves from the first conveyance chamber 60*a* to the outer peripheral surface of the developing roller 63. The toner contained in the developer D moves from the developing roller 63 to the surface of the photosensitive drum 12*b*. As a result, the electrostatic latent image on the photosensitive drum 12*b* is developed.

The remainder of the developer D that has not been used for development moves through the first conveyance chamber 60*a* and reaches the vicinity of the end portion in the X1 direction. At the end portion in the X1 direction, the second conveying unit 72 of the first mixer 61 pushes the developer D back toward the X2 direction. Before the start of use of the image forming apparatus 1, an appropriate amount (not excessive) of developer D is contained in the second conveyance chamber 60*b*. Therefore, the second conveying unit 72 pushes back substantially the entire amount of the developer D, which has reached the end portion in the X1 direction, in the X2 direction. Therefore, most of the developer D does not reach the discharge unit 60*e* and is not discharged from the discharge port 67*a*. The developer D pushed back by the second conveying unit 72 returns to the second conveyance chamber 60*b* through the first communication port 60*c* at the end portion in the X1 direction. As a result, the developer D circulates inside the developing device 12*a*.

As the image forming apparatus 1 is used for a long time, the toner in the developer D is consumed. The control unit detects the toner concentration of the developing device 12*a* with the toner concentration detector. The control unit replenishes the developing device 12*a* with the developer from the developer cartridge of a developer replenishing device when the detected toner concentration becomes a predetermined value or less. The control unit adds a predetermined amount of developer from the developer cartridge. For example, the developer is supplied from the developer replenishing device to the end portion of the first conveyance chamber 60*a* in the X1 direction. The added developer mixes with the existing developer D and circulates in the developing device 12*a*.

Before the start of use of the image forming apparatus 1, the developer D contained in the second conveyance chamber 60*b* of the developing device 12*a* has a higher ratio of carrier to toner (is relatively toner poor). On the other hand, the developer contained in the developer cartridge has a lower ratio of carrier to toner (is relatively toner rich). When the developer is added from the developer cartridge to the developing device 12*a*, the toner concentration of the developing device 12*a* increases.

Even though the toner of the developer is consumed when using the image forming apparatus 1, the carrier is not substantially consumed and thus remains in the developing device 12*a*. Accordingly, a small amount of carrier is contained in the developer in the developer cartridge. When the developer is added from the developer cartridge to the developing device 12*a*, surplus carrier is provided inside the developing device 12*a*. However, the second conveying unit 72 is sized such that it cannot push back substantially the entire amount of the developer that reaches it when there is a surplus amount inside the developing device 12*a*. Thus, a part of the developer gets over (past) the second conveying unit 72 and reaches the discharge unit 60*e*. The developer that has reached the discharge unit 60*e* is conveyed in the X1 direction by the third conveying unit 73 and discharged from the discharge port 67*a*. Most of the discharged developer is older carrier that have been used for a long time and may have deteriorated. Thus, when a new carrier is added, old carrier is discharged. Accordingly, the carriers inside the developing device 12*a* are gradually replaced over time.

When the developing device 12*a* is inclined/tilted during transport or installation before the start of use of the image forming apparatus 1, the developer D moves around inside the developing device 12*a*. As a result, when the use of the image forming apparatus 1 is begun, the developer D may be unevenly disposed to one side within the developing device 12*a*. In particular, when the developer D is sealed in the same conveyance chamber as the discharge unit 60*e*, there is a possibility that the developer D will be in the vicinity of the discharge unit 60*e*. In such a case, even though the developer D is sealed in an appropriate amount, the second conveying unit 72 disposed in the vicinity of the discharge unit 60*e* cannot push back substantially the entire amount of the developer D since some portion is already beyond the second conveying unit 72 in the X1 direction. As a result, developer D containing a new carrier may be discharged from the discharge unit 60*e* immediately after the start of use of the image forming apparatus 1.

The developing device 12*a* according to the present embodiment includes the developing roller 63, the first conveyance chamber 60*a*, the second conveyance chamber 60*b*, the closing member 80, the initial developer D, and the discharge unit 60*e*. The closing member 80 closes the pair of communication ports 60*c* and 60*d*, which are disposed apart from each other in the axial direction of the developing roller 63 and allow the first conveyance chamber 60*a* and the second conveyance chamber 60*b* to communicate with each other when open. Thus, the initial developer D can be contained in only one of the first conveyance chamber 60*a* or the second conveyance chamber 60*b*. By design, the discharge unit 60*e* is provided for only the other one of the first conveyance chamber 60*a* or the second conveyance chamber 60*b* to prevent unintended discharge of developer at startup of the image forming apparatus 1.

Since the initial developer D is contained in a conveyance chamber different from the one with the discharge unit 60*e*, the developer D will not be initially disposed near the discharge unit 60*e*. The developer D is gradually conveyed inside the developing device 12*a* and reaches the vicinity of the discharge unit 60*e*. If the developer D is initially sealed at an appropriate amount, the second conveying unit disposed in the vicinity of the discharge unit 60*e* can push back substantially the entire amount of the developer D. Thus, immediately after the start of use of the image forming apparatus 1, the developer D including a new carrier is not discharged from the discharge unit 60*e*. Therefore, the developing device 12*a* according to the embodiment can prevent the unintended discharge of the developer D.

In this embodiment, the initial load of developer D is contained only in the second conveyance chamber 60*b*. The discharge unit 60*e* is formed only in the first conveyance chamber 60*a*.

The first conveyance chamber 60*a* includes the opening 60*h* in which the developing roller 63 is disposed, but the second conveyance chamber 60*b* does not have an opening to the outside. By containing the developer D only in the second conveyance chamber 60*b*, leakage of the developer D to the outside is prevented.

The discharge unit 60*e* is formed on the downstream side in the X1 direction further than the first communication port 60*c* disposed on the downstream side in the X1 direction between the pair of communication ports 60*c* and 60*d*. The developer D contained in the second conveyance chamber 60*b* gradually flows into the first conveyance chamber 60*a* from the second communication port 60*d* disposed on the upstream side in the X1 direction. The developer D is conveyed in the X1 direction through the first conveyance chamber 60*a* and reaches the vicinity of the discharge unit 60*e* over time. Therefore, the second conveying unit disposed in the vicinity of the discharge unit 60*e* can push back substantially the entire amount of the developer D. Thus, immediately after the start of use of the image forming apparatus 1, the developer D containing a new carrier is not discharged from the discharge unit 60*e*. Therefore, the developing device 12*a* according to the embodiment can prevent unintended discharge of the developer D.

The image forming unit 12 according to the embodiment includes the photosensitive drum 12*b*, the developing device 12*a* described above, the charger 12*c*, and the cleaning blade 12*d*. The photosensitive drum 12*b* carries an electrostatic latent image. The developing device 12*a* develops the electrostatic latent image with a developer. The charger 12*c* charges the photosensitive drum 12*b*. The cleaning blade 12*d* removes the developer attached to the photosensitive drum 12*b*. The image forming apparatus 1 according to the embodiment includes the developing device 12*a* described above. The developing device 12*a* described above can prevent the unintended discharge of the developer D. Therefore, the image forming unit 12 and the image forming apparatus 1 can prevent image defects due to lack of developer.

In the embodiment described above, the first conveyance chamber 60*a* and the second conveyance chamber 60*b* are disposed in parallel in the horizontal direction. In other embodiments, the first conveyance chamber 60*a* and the second conveyance chamber 60*b* may be disposed in parallel in the vertical direction or any other.

In the embodiment described above, the discharge unit 60*e* is disposed at the end portion of the first conveyance chamber 60*a* and includes the discharge port 67*a* that opens at the bottom wall. However, the discharge unit 60*e* may be disposed at a position other than the end portion of the first conveyance chamber 60*a* or the second conveyance chamber 60*b* and may include a discharge port that opens at the side wall. The discharge port that opens to the side wall discharges the developer conveyed through the upper layer when surplus developer is generated and the bulk amount of the developer increases.

In the embodiment described above, the closing member 80 is pulled out in the X1 direction, and the pair of communication ports 60*c* and 60*d* are thus opened. The closing member 80 may instead be pulled out in a direction different from the X1 direction. For example, the closing member 80 may be pulled vertically upward.

According to at least one embodiment described above, the closing member 80, the initial developer D, and the discharge unit 60*e* are provided. The closing member 80 initially closes the pair of communication ports 60*c* and 60*d*, which otherwise allow the first conveyance chamber 60*a* and the second conveyance chamber 60*b* to communicate with each other. But the closing member 80 is removable or moveable in such a way as to open the pair of communication ports 60*c* and 60*d*. The initial developer D is contained in only one of the first conveyance chamber 60*a* or the second conveyance chamber 60*b*. The discharge unit 60*e* is formed only in the other of the first conveyance chamber 60*a* or the second conveyance chamber 60*b*. Thus, the unintended discharge of the developer D at startup can be prevented.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A developing device, comprising:
a first chamber;
a developing roller provided in the first chamber, a part of the developing roller being exposed from the first chamber;
a first mixer in the first chamber and configured to convey developer in a first direction along a rotational axis of the developing roller;
a second chamber connected to the first chamber via a first port and a second port that are apart from each other in the first direction;
a second mixer in the second chamber and configured to convey developer in a second direction opposite to the first direction;
one or more removable seals closing the first port and the second port;
a developer contained in one of the first and second chambers; and
a developer discharge port on the other one of the first and second chambers.

2. The developing device according to claim 1, wherein the one or more removable seals block transfer of developer between the first and second chambers until removal of the one or more removable seals.

3. The developing device according to claim 1, wherein no developer discharge port is provided on the other one of the first and second chambers.

4. The developing device according to claim 1, wherein the developer is contained in the second chamber, and the developer discharge port is on the first chamber.

5. The developing device according to claim 1, wherein the first mixer comprises a first portion having a first spiral blade, a second portion having a second spiral blade, and a third portion having a third spiral blade,
the second spiral blade being in a reverse direction from the first spiral blade, and
the third spiral blade having a height less than the first spiral blade.

6. The developing device according to claim 1, wherein the developer is contained in the first chamber, and the developer discharge port is on the second chamber.

7. The developing device according to claim 1, wherein the one or more removable seals are removable when pulled in a direction along the rotational axis of the developing roller.

8. The developing device according to claim 1, wherein the one or more removable seals include a seal member that includes a first portion provided in one of the first and second chambers and a second portion provided outside said one of the first and second chambers.

9. The developing device according to claim 8, wherein the second portion of the seal member is connected to the first portion at a first end and folded at a second end opposite to the first end.

10. The developing device according to claim 8, wherein the first portion of the seal member is provided downstream with respect to the second portion in the first direction.

11. An image forming apparatus, comprising:
an image carrier on which an electrostatic latent image is formed; and
a developing device configured to supply toner to the image carrier, the developing device comprising:
a first chamber;
a developing roller provided in the first chamber, a part of the developing roller being exposed from the first chamber;
a first mixer in the first chamber and configured to convey developer in a first direction along a rotational axis of the developing roller;
a second chamber connected to the first chamber via a first port and a second port that are apart from each other in the first direction;
a second mixer in the second chamber and configured to convey developer in a second direction opposite to the first direction;
one or more removable seals closing the first port and the second port;
a developer contained in one of the first and second chambers; and
a developer discharge port on the other one of the first and second chambers.

12. The image forming apparatus according to claim 11, wherein the one or more removable seals block transfer of developer between the first and second chambers until removal of the one or more removable seals.

13. The image forming apparatus according to claim 11, wherein the developer is contained in the first chamber, and the developer discharge port is on the second chamber.

14. The image forming apparatus according to claim 11, wherein the developer is contained in the second chamber, and the developer discharge port is on the first chamber.

15. The image forming apparatus according to claim 11, wherein the one or more removable seals are removable by being pulled in a direction along the rotational axis of the developing roller.

16. The image forming apparatus according to claim 11, wherein the one or more removable seals include a seal member that includes a first portion provided in one of the first and second chambers and a second portion provided outside said one of the first and second chambers.

17. The image forming apparatus according to claim 16, wherein the second portion of the seal member is connected to the first portion at a first end and folded at a second end opposite to the first end.

18. The image forming apparatus according to claim 11, wherein the first mixer comprises a first portion having a first spiral blade, a second portion having a second spiral blade, and a third portion having a third spiral blade, the second spiral blade being in a reverse direction from the first spiral blade, and the third spiral blade having a height less than the first spiral blade.

19. A printer apparatus, comprising:

a plurality of image forming units with different toner types, wherein each image forming unit in the plurality of image forming units respectively includes:

a developing device comprising:

a first chamber;

a developing roller provided in the first chamber, a part of the developing roller being exposed from the first chamber;

a first mixer in the first chamber and configured to convey developer in a first direction along a rotational axis of the developing roller;

a second chamber connected to the first chamber via a first port and a second port that are spaced from each other in the first direction;

a second mixer in the second chamber and configured to convey developer in a second direction opposite to the first direction;

a removable seal closing the first port and the second port;

a developer contained in one of the first and second chambers; and a developer discharge port on the second chamber.

20. The printer according to claim 19, wherein the removable seal comprises a plurality of portions.

* * * * *